US011230360B2

(12) United States Patent
Weber et al.

(10) Patent No.: US 11,230,360 B2
(45) Date of Patent: Jan. 25, 2022

(54) ELECTRIC POWER STEERING SYSTEM FOR MARINE VESSEL

(71) Applicant: Steering Solutions IP Holding Corporation, Saginaw, MI (US)

(72) Inventors: John E. Weber, Pinconning, MI (US); Rod M. Sanderson, Beaverton, MI (US); Andrew E. Maschke, Birch Run, MI (US); Brian G. Maust, Unionville, MI (US); Christopher R. Douglas, Saginaw, MI (US); Philogene F. Rousseau, Freeland, MI (US); Brant R. Colbry, Bay City, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 2 days.

(21) Appl. No.: 16/855,813

(22) Filed: Apr. 22, 2020

(65) Prior Publication Data

US 2021/0331776 A1 Oct. 28, 2021

(51) Int. Cl.

| | |
|---|---|
| ***B63H 25/20*** | (2006.01) |
| ***B63H 25/24*** | (2006.01) |
| *B63H 25/02* | (2006.01) |

(52) U.S. Cl.
CPC ..... *B63H 25/20* (2013.01); *B63H 25/24* (2013.01); *B63H 2025/022* (2013.01)

(58) Field of Classification Search
CPC .. B63H 2025/028; B63H 25/10; B63H 25/14; B63H 25/18; B63H 25/20; B63H 25/24
See application file for complete search history.

(56) References Cited

U.S. PATENT DOCUMENTS

| | | | | |
|---|---|---|---|---|
| 2010/0101472 | A1* | 4/2010 | Miyazaki | B63H 25/14 114/144 R |
| 2017/0106961 | A1* | 4/2017 | Weber | B63H 25/42 |
| 2017/0106962 | A1* | 4/2017 | Weber | B63H 25/02 |

* cited by examiner

*Primary Examiner* — Andrew Polay
(74) *Attorney, Agent, or Firm* — Dickinson Wright PLLC

(57) ABSTRACT

A steering system for a marine vessel includes a cable translatable in response to a steering input command. The steering system also includes a rudder pivotable to steer the marine vessel. The steering system further includes a link member operatively coupled to the rudder. The steering system yet further includes a sensor positioned to detect a load associated with the cable in response to the steering input command. The steering system also includes an electric power steering system in operative communication with the sensor to receive a signal from the sensor and provide a powered assist to the link member.

4 Claims, 3 Drawing Sheets

ELECTRIC POWER STEERING SYSTEM FOR MARINE VESSEL

FIELD OF THE INVENTION

The present disclosure relates to a steering system for a marine vessel and, more particularly, to an electric power steering system for a marine vessel.

BACKGROUND

It is common for marine inboard or inboard/outboard drive steering to have a hydraulic power assist to provide a more comfortable and efficient steering experience for an operator of a marine craft. Generally, a hydraulic cylinder is attached to the lower unit or rudder steering link at the transom and pressurized fluid is supplied from a pump located on the engine. At the helm of the vessel, there is usually a mechanical rotary push-pull cable steering system. This cable is routed back to the transom and is attached to the same steering link for the lower unit. The cable passes through a shuttle valve on top of the hydraulic cylinder. As the load in the cable increases (i.e., turning the wheel which pushes or pulls the cable), the valve actuates and allows fluid to enter the cylinder, thereby pushing or pulling the rudder/lower unit to steer the vessel. If there is a failure in the hydraulic system, the operator can still steer the vessel (without power assist) via the mechanical cable connection.

There are a few undesirable issues associated with the above-described systems. For example, there are environmental concerns due to potential leaking of the pressurized fluid. Hoses are difficult to install and protect, thereby causing installation and maintenance challenges. The above-described pump must constantly turn, which leads to inefficient, high energy usage. As a final example, the above-described system makes poor use of the bilge space due to its large volume. Accordingly, it would be desirable to provide an alternative to the hydraulic steering assist systems currently in use.

SUMMARY

According to one aspect of the disclosure, a steering system for a marine vessel includes a cable translatable in response to a steering input command. The steering system also includes a rudder pivotable to steer the marine vessel. The steering system further includes a link member operatively coupled to the rudder. The steering system yet further includes a sensor positioned to detect a load associated with the cable in response to the steering input command. The steering system also includes an electric power steering system in operative communication with the sensor to receive a signal from the sensor and provide a powered assist to the link member.

According to another aspect of the disclosure, an electric power steering system for a marine vessel includes a sensor positioned to detect a load associated with a steering input command. The electric power steering system also includes a controller in operative communication with the sensor to receive a signal from the sensor and provide a powered assist to a rudder of the marine vessel.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the Figures, where the invention will be described with reference to specific embodiments, without limiting same, a steering system for a marine vessel is illustrated.

Figure 1:
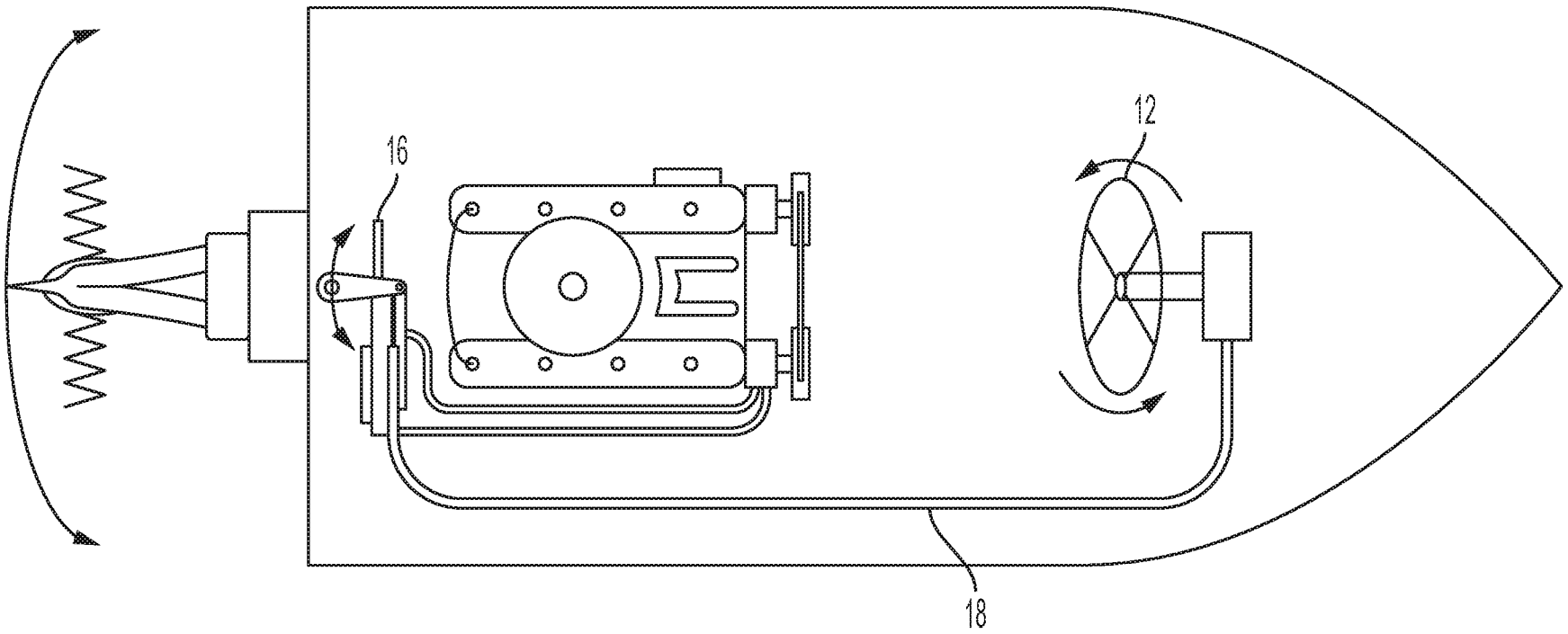
FIG. 1 is a schematic illustration of a steering system for a marine vessel.

FIG. 1 generally illustrates a steering system 10 according to the principles of the present disclosure. The steering system 10 is disposed in a marine vessel. The marine vessel may include any suitable marine vessel that requires manual steering. As will be appreciated from the disclosure herein, the steering system 10 includes an electric power assist system for lowering the required manual effort required by an operator of the marine vessel.

The steering system 10 includes a steering mechanism or hand wheel 12. The hand wheel 12 may be disposed on a helm of the marine vessel or some other suitable location. The operator of marine vessel engages the hand wheel 12 in order to control steering of the marine vessel. The steering system 10 includes a propulsion mechanism that includes a motor 14 and a rudder 16. While only the motor 14 and the rudder 16 are described herein, it should be understood that the propulsion mechanism may include additional or fewer components than described herein. For example, the propulsion mechanism may include one or more motors, a propulsion engine, one or more rudders, one or more propellers, other suitable components, or a combination thereof.

The motor 14 may include any suitable motor, such as an outboard motor, an inboard motor, and the like. The operator of the marine vessel may engage a throttle (not shown) disposed proximate the hand wheel 12 to engage and/or control the motor 14. For example, the operator may increase or decrease a rotational velocity of a propeller associated with the motor 14 by moving the throttle. Additionally, or alternatively, the operator may raise or lower the propeller of the motor 14 using one or more switches disposed on the throttle or proximate the throttle.

In the illustrated embodiments, the hand wheel 12 may be in direct communication with the rudder 16. For example, the system 10 may include a mechanism that connects the hand wheel 12 to the rudder 16. For example, the mechanism coupling the hand wheel 12 to the rudder 16 is a push/pull cable 18 in some embodiments. As the operator turns the hand wheel 12, the cable 18 translates the rotation movement of the hand wheel 12, which causes the rudder 16 to move in a first direction or a second direction, opposite the first direction (FIG. 2).

Figure 2:
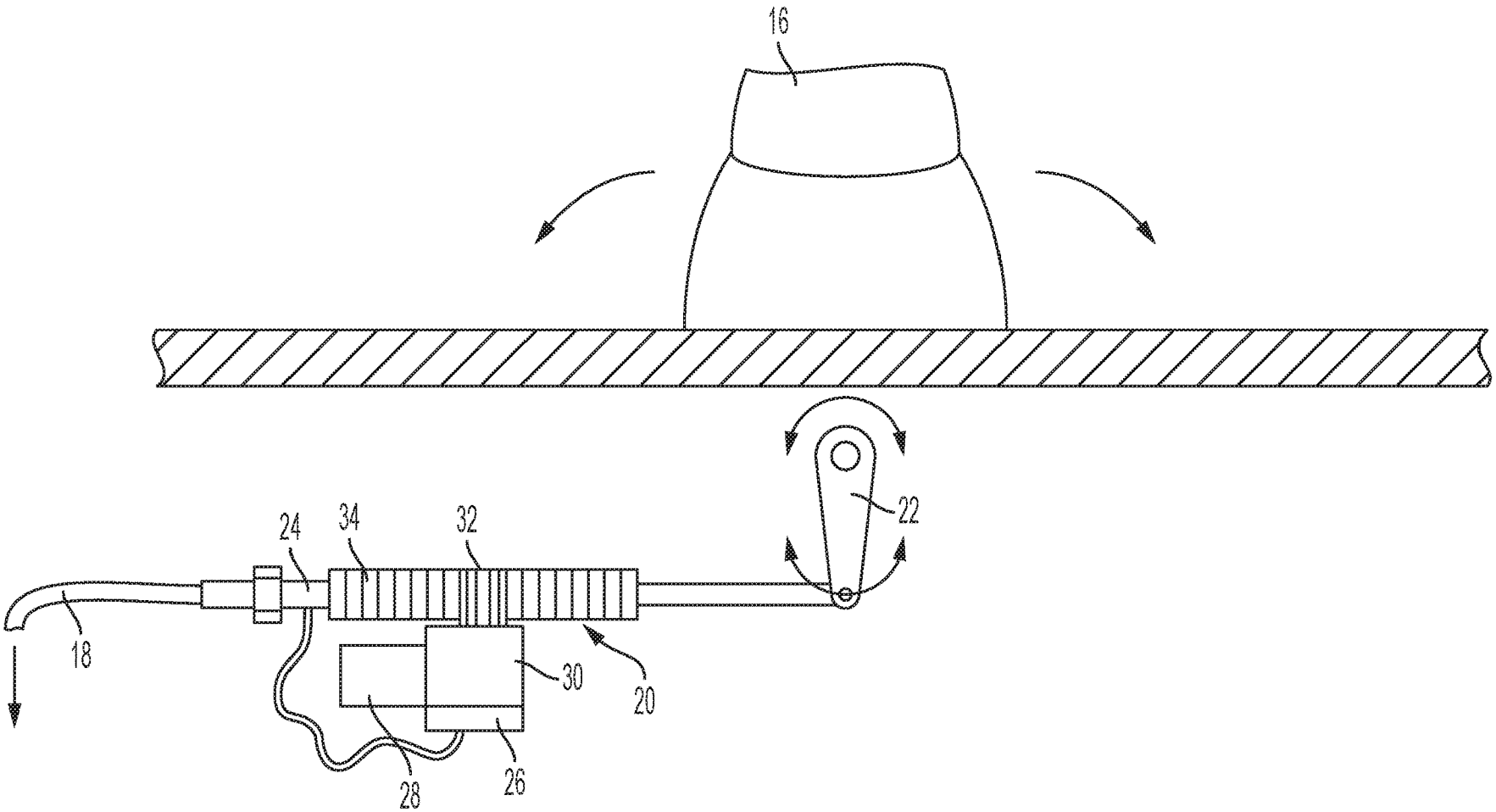
FIG. 2 is a schematic illustration of an electric power steering system for the marine vessel according to an aspect of the disclosure.

Referring now to FIG. 2, an electric power steering (EPS) system 20 that is part of the overall steering system 10 is illustrated. The EPS system 20 interacts with the cable 18 and the rudder 16 to provide assistance to the steering effort of the marine vessel operator. As described above, the cable 18 is in operative communication with the hand wheel 12 proximate a first end of the cable 18 at the helm of the marine vessel and in operative communication with the rudder 16 proximate a second end of the cable 18. While contemplated that a direct connection between the cable 18 and the rudder 16 is possible, as shown in the illustrated embodiment a link member 22 may couple the cable 18 to the rudder 16. In such an embodiment, the link member 22 is pivotable about an axis upon translation of the cable 18 due to steering inputs at the hand wheel 12. The link member 22 is operatively coupled to the rudder 16 to convert the translational push/pull motion of the cable 18 to rotary motion, thereby facilitating steering movement of the rudder 16.

The EPS system 20 includes a linear force sensor 24 that is positioned on the cable 18 between the first and second ends of the cable 18. The linear force sensor 24 is in operative communication (i.e., wired or wireless) with a controller 26 in a manner that communicates a signal detected by the linear force sensor 24 to the controller 26. The controller 26 may include any suitable controller or processor, such as those described herein. The controller 26 may be configured to executed instructions stored on a memory. The memory may comprise a single disk or a plurality of disks (e.g., hard drives), and includes a storage management module that manages one or more partitions within the memory. In some embodiments, memory may include flash memory, semiconductor (solid state) memory or the like. The memory may include Random Access Memory (RAM), a Read-Only Memory (ROM), or a combination thereof.

The controller 26 receives the signal from the linear force sensor 24 to determine a force input of the cable 18 that is indicative of the steering input at the hand wheel 12. Although detection of the steering input at the hand wheel 12 is illustrated and described herein as being performed with the linear force sensor 24, it is to be appreciated that such detection may be made in other embodiments with a torque sensor at the helm of the marine vessel and which is operatively coupled to the hand wheel 12 or an associated rotatable component.

The controller 26 is also in operative communication with an electric motor 28 of the EPS system 20. The electric motor 28 includes an output shaft that drives a gear arrangement 30 within a gearbox. An output of the gear arrangement 30 is operatively coupled to a pinion 32 that is in teeth meshed engagement with a rack 34. The rack 34 is operatively coupled to the cable 18. The rack 34 is positioned closer to the link member 22 than the proximity of the linear force sensor 24 (or torque sensor) to the link member 22. The link member 22 may be part of a multi-component linkage mechanism that the rack 34 is directly coupled to in some embodiments.

In operation, the linear force sensor 24 communicates the load to the controller 26, which then applies an appropriate assist with the electric motor 28 and the driven rack 34. The powered movement of the rack 34 rotates the link member 22 to ultimately steer the marine vessel via the rudder 16.

Figure 3:
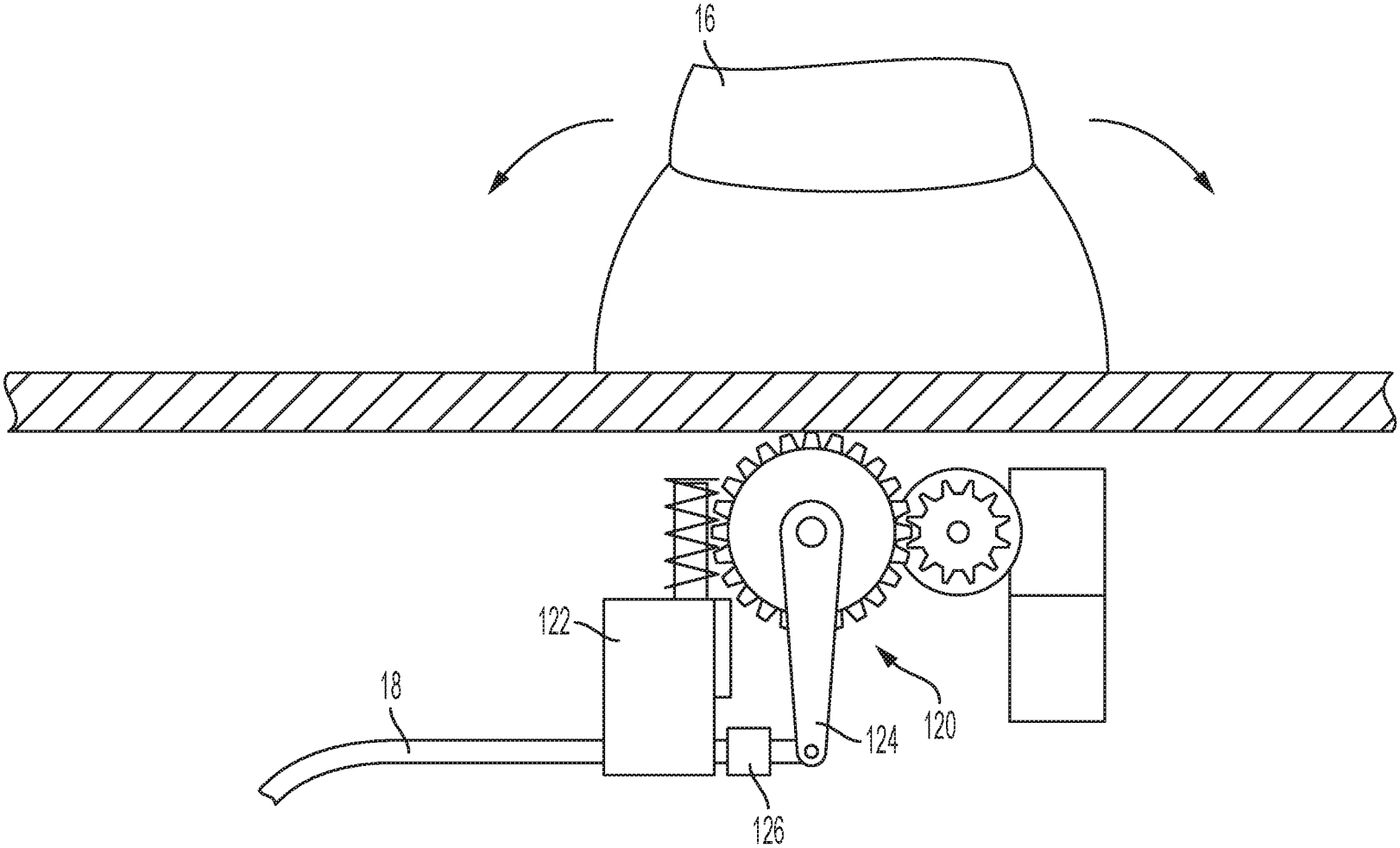
FIG. 3 is a schematic illustration of the electric power steering system for the marine vessel according to another aspect of the disclosure.

Referring now to FIG. 3, another aspect of the EPS system is illustrated and referred to generally with numeral 120. In particular, the EPS system 120 does not require a rack and pinion. FIG. 3 would operate similarly to FIG. 2, but instead of a rack would utilize a rotary-type gearbox (e.g., worm, pinion, etc.) 122 connected directly to the rudder shaft to multiply torque from an electric motor to the shaft. The push-pull cable 18 is connected directly to the rudder arm 124. At the connection point a force sensor 126 is installed. A controller would monitor force in the cable through the force sensor 126 (and therefore load/torque experienced by operator) and supply energy to the motor and gearbox 122 to assist in steering the vessel. If a position sensor is installed at the helm (steering position) and the rudder (rudder angle) then the cable 18 could be removed to offer a true steer-by-wire operation.

The embodiments disclosed herein allow an operator to continue to manually steer the marine vessel if a loss of electrical power/assistance occurs. This continued operability is available based on the mechanical connection to the link member 22 (or larger linkage mechanism). However, it is contemplated that the mechanical connection may be eliminated to avoid the need for the cable 18 if the system is converted into a true steer-by-wire system that communicates the steering input electrically to the EPS system 20.

The embodiments disclosed herein provide a low cost alternative to complex electric systems and some hydraulic systems. By avoiding hydraulics, no fluids are present to leak and the system has a low energy usage in comparison. The EPS system 20 may also easily be adapted to an autopilot function, is easily installed and increases life of the cable 18 by protecting it from a high load. The system results in minimal vibration feedback to the helm with a smooth steering force lock-to-lock. The system is tunable via the controller 26 and associated software for feel and function—and if a true steer-by-wire system (i.e., push/pull not installed)—then an even wider variety of desirable features can be obtained through software programming. For example, adjustable lock-to-lock turns ratio, adjustable end stop positions, and non-moving steering wheel while in autopilot mode functions may be achieved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A steering system for a marine vessel comprising:

a cable translatable in response to a steering input command;

a rudder pivotable to steer the marine vessel;

a link member operatively coupled to the rudder;

a sensor positioned to detect a load associated with the cable in response to the steering input command, wherein the sensor is a linear force sensor located on the cable; and an electric power steering system in operative communication with the sensor to receive a signal from the sensor and provide a powered assist to the link member.

2. The steering system of claim 1, wherein the electric power steering system comprises:

a rack operatively coupled to the link member;

a pinion engaged with the rack to impart translation of the rack during rotation of the pinion;

an electric motor operatively coupled to the pinion; and a controller in operative communication with the sensor and with the electric motor.

3. The steering system of claim 2, wherein the electric motor and the pinion are connected with a gear arrangement.

4. The steering system of claim 1, wherein the link member is part of a linkage mechanism, wherein the electric power steering system is coupled to the linkage mechanism.

* * * * *